US006755604B1

(12) United States Patent
Schaeff

(10) Patent No.: US 6,755,604 B1
(45) Date of Patent: Jun. 29, 2004

(54) WHEELED SHOVEL LOADER

(75) Inventor: Hans Schaeff, Langenburg (DE)

(73) Assignee: Schaeff-Terex GmbH & Co. KG, Langenburg (DE)

( * ) Notice: Subject to any disclaimer, the term of this patent is extended or adjusted under 35 U.S.C. 154(b) by 0 days.

(21) Appl. No.: 09/830,552

(22) PCT Filed: Oct. 2, 1999

(86) PCT No.: PCT/EP99/07319

§ 371 (c)(1),
(2), (4) Date: May 4, 2001

(87) PCT Pub. No.: WO00/31351

PCT Pub. Date: Jun. 2, 2000

(30) Foreign Application Priority Data

Nov. 20, 1998 (DE) ..... 198 53 523

(51) Int. Cl.[7] ..... E02F 3/00

(52) U.S. Cl. ..... 414/700; 414/706; 414/708; 414/712; 414/713; 414/917

(58) Field of Search ..... 414/700, 699, 414/706, 708, 710, 712, 713, 917

(56) References Cited

U.S. PATENT DOCUMENTS

| | | | | |
|---|---|---|---|---|
| 3,327,880 A | * | 6/1967 | Brown | 214/770 |
| 3,828,939 A | | 8/1974 | Tranchero | |
| 4,053,075 A | * | 10/1977 | Stedman | 214/770 |
| 4,583,907 A | | 4/1986 | Wimberley | |
| 5,088,020 A | * | 2/1992 | Nishida et al. | 414/699 |
| 5,188,502 A | * | 2/1993 | Tonsor et al. | 414/700 |
| 5,609,464 A | * | 3/1997 | Moffitt et al. | 414/685 |

FOREIGN PATENT DOCUMENTS

| | | | | |
|---|---|---|---|---|
| DE | 11 74 702 | | 7/1964 | |
| DE | 33 41 614 | | 5/1985 | |
| DE | 3341614 A1 | * | 5/1985 | E02F/3/36 |
| EP | 0 077 308 | | 3/1987 | |
| FR | 2 512 796 | | 3/1983 | |
| FR | 2512796 A | * | 3/1983 | B65G/65/02 |
| FR | 2 602 637 | | 2/1988 | |
| WO | WO 95 31611 | | 11/1995 | |

OTHER PUBLICATIONS

International Search Report dated Feb. 8, 2000.

* cited by examiner

*Primary Examiner*—Eileen D. Lillis
*Assistant Examiner*—Michael Lowe
(74) *Attorney, Agent, or Firm*—Shlesinger Arkwright & Garvey LLP

(57) ABSTRACT

The present invention relates to a wheeled shovel loader that comprises a boom (3) capable of pivoting about an axis (4) as well as loading shovel (13) that can be actuated by a tilting structure (11, 12). According to this invention, at least one additional arm (7) connecting the boom (3) and the loading shovel (13) is hinged so as to be capable of displacement in the same way as a parallel linkage or parallelogram on said arm (3) under the action of at least a first connecting rod (8) and at least a second connecting rod (9). The shovel loader of the present invention comprises means for controlling the displacement of the additional arm (7) according to the angular position of the boom (3) relative to its pivot axis (4), as well as means for maintaining the loading shovel (13) in a horizontal position.

23 Claims, 5 Drawing Sheets

WHEELED SHOVEL LOADER

The invention concerns a wheeled shovel loader with the characteristics of-the generic portion of claim 1.

These types of shovel loaders, which travel on, for example, wheels or tracks, are well known and are widely used. These shovel loaders are particularly used for the loading of trucks with earth and building materials. During the loading of tall trucks or large dumping vehicles, particularly with lightweight bulk goods such as coal, coke, wood chips, garbage, etc., shovel loaders with a very large loading height are needed. These types of shovel loaders have available, for example, a shovel pivot point of at least 5 meters over the road level. In order to attain this loading height, there are, on one hand, very large shovel loaders with correspondingly tall hinged long booms with a corresponding unloaded weight and a large engine output (for example, 30 tons unloaded weight at 300 horsepower) for the loading of heavy goods. However, these shovel loaders are too large and too expensive for the loading of light goods. On the other hand, there are the so-called telescopic loaders with light material shovels, which are not very well liked in practice because they are relatively slow and very susceptible to wear and tear. The telescopes used in telescopic stackers run in slides which wear out when exposed to dust and dirt and higher sliding speeds, leading to breakdowns.

Proceeding from this, the invention has as its object the increasing of the loading height of a relatively small, mass-produced wheeled shovel loader in such a way that it is usable for the loading of tall trucks with light bulk goods without reduction of its stability.

To achieve this object, a shovel loader with the characteristics of claim 1 is suggested. According to this, the shovel loader has an additional arm, connecting the boom and the tool, which is hinged on the boom so as to be capable of displacement in the same way as a parallel linkage or parallelogram by means of a first connecting rod and a second connecting rod. When the boom is pivoted upward, extension of the entire boom is achieved by operation of the additional arm hinged on the boom. According to the invention, the shovel loader furthermore has means available for control of the position of the additional arm depending on the angle of the boom relative to the boom swivel pin. These means ensure that the additional arm is only extended from its position retracted onto the boom after a predetermined angle of the boom has been reached, thereby preventing an extension of the boom which impairs the stability of the shovel loader. Through the further means provided according to the invention for keeping the loading shovel parallel, goods in the loading shovel are prevented from falling out when the loading shovel is lifted.

In an embodiment of the invention, displacement of the additional arm from a position retracted onto the boom only occurs after the boom has passed through its horizontal position as it pivots upward. This ensures that extension of the entire boom only occurs above the horizontal position of the boom. Conversely, it is of course also ensured that, as the boom moves downward, the additional arm is completely folded in, at latest, before the boom passes through its horizontal position.

In an advantageous embodiment of the invention, the means for control of the displacement of the additional arm includes at least one angle sensor.

In another embodiment of the invention, the means for control of the displacement of the additional arm include at least one position sensor.

In a particularly advantageous embodiment of the invention, the additional arm for extension of the loading shovel is displaceable in an essentially horizontal direction even below the horizontal position of the boom, with the boom able to be shifted into a so-called floating position to adjust for the circular path of the loading shovel caused by the displacement of the additional arm. This measure allows the additional arm to be displaced forward in, for example, specific steering situations in which the shovel loader cannot be moved any nearer to the location of pickup and/or delivery of the goods to be moved. Before the boom can be lifted from this position, the additional arm must be completely retracted to maintain tipping resistance. For this purpose, an electric angle or position detector is advantageously provided for release of the hub movement by the boom.

In a further embodiment of the invention, the lengths of the first connecting rod and the second connecting rod are essentially equal.

In another embodiment of the invention, the first connecting rod is shorter or longer than the second connecting rod. Due to the unequal lengths of the first connecting rod and the second connecting rod, the end position of the additional arm in its completely folded out position can be influenced. If, for example, the first connecting rod, i.e., the connecting rod hinged on the boom further from the chassis, is shorter than the length of the second connecting rod, which is hinged on the boom closer to the chassis, the additional arm displays a relatively flat positioning in relation to the completely raised boom.

Further advantageous embodiments are described in the sub-claims.

Of course, the characteristics mentioned in the preceding and described in the following are not usable only in the combinations indicated, but also in other combinations or alone, without leaving the framework of the present invention.

The invention is depicted with reference to an exemplary embodiment in the drawings and will be described in more detail in the following with reference to the drawings.

Figure 1:
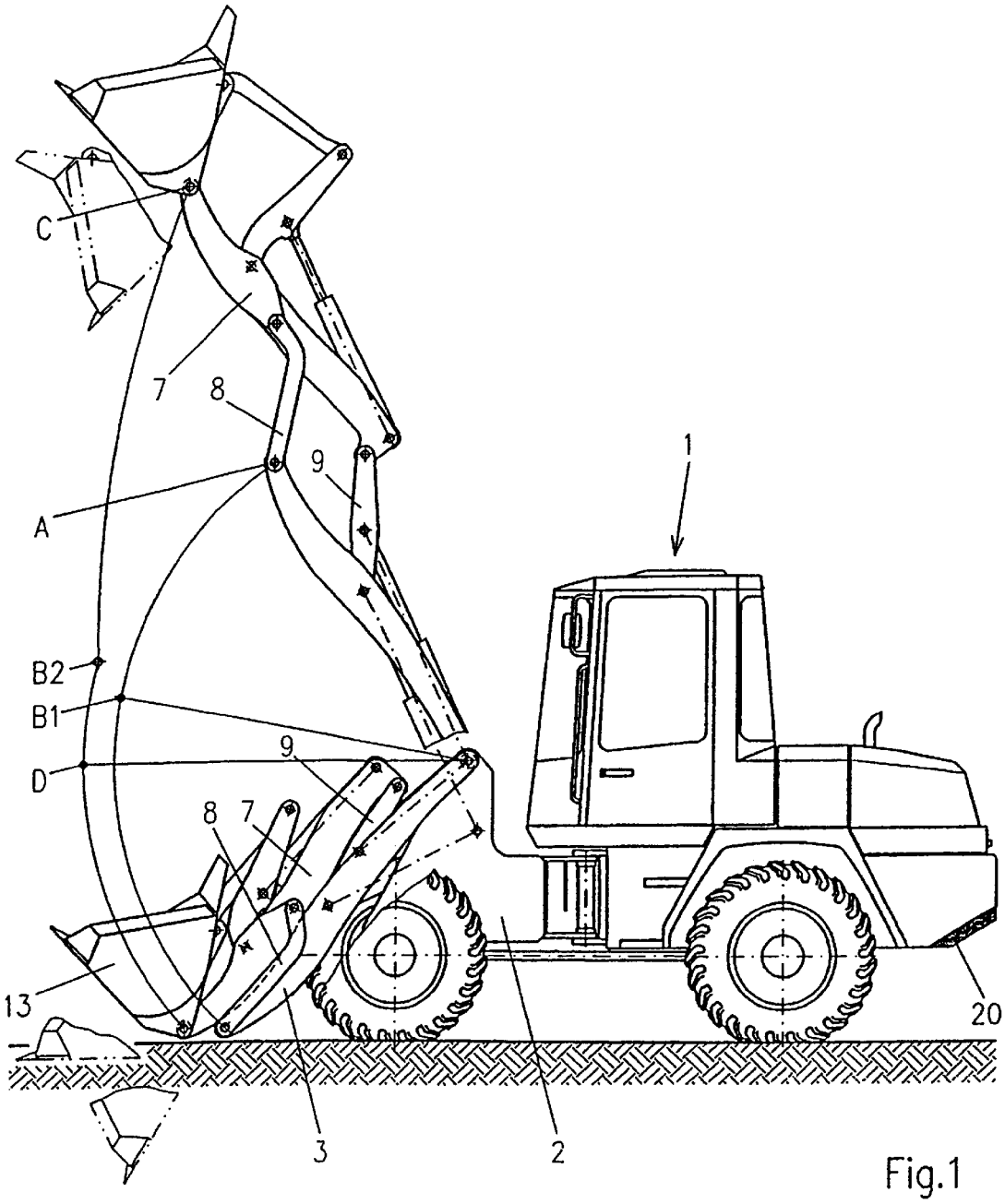
FIG. 1 shows a shovel loader according to the invention in a side view with the boom completely retracted and completely extended.
Figure 4A:
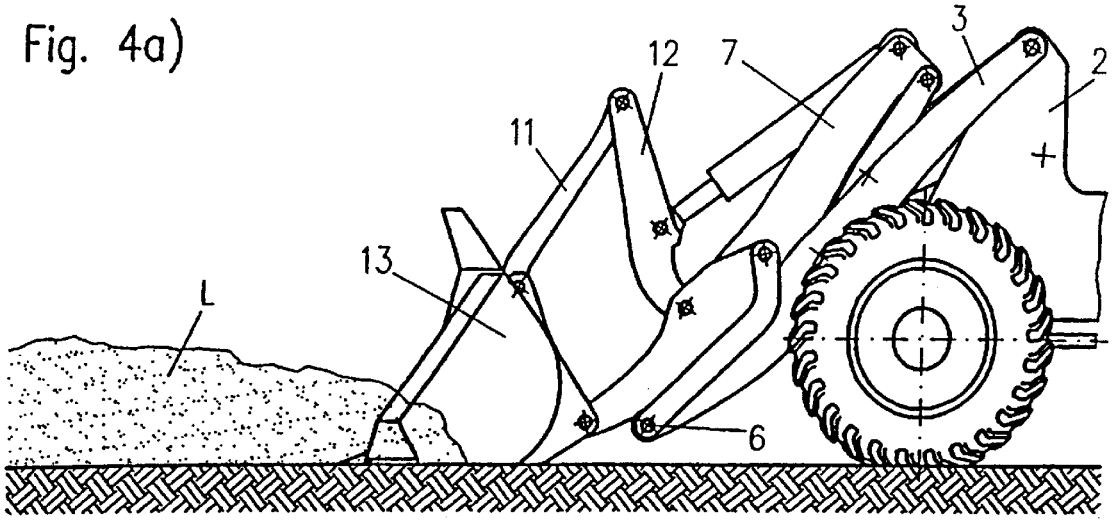
Figure 4B:
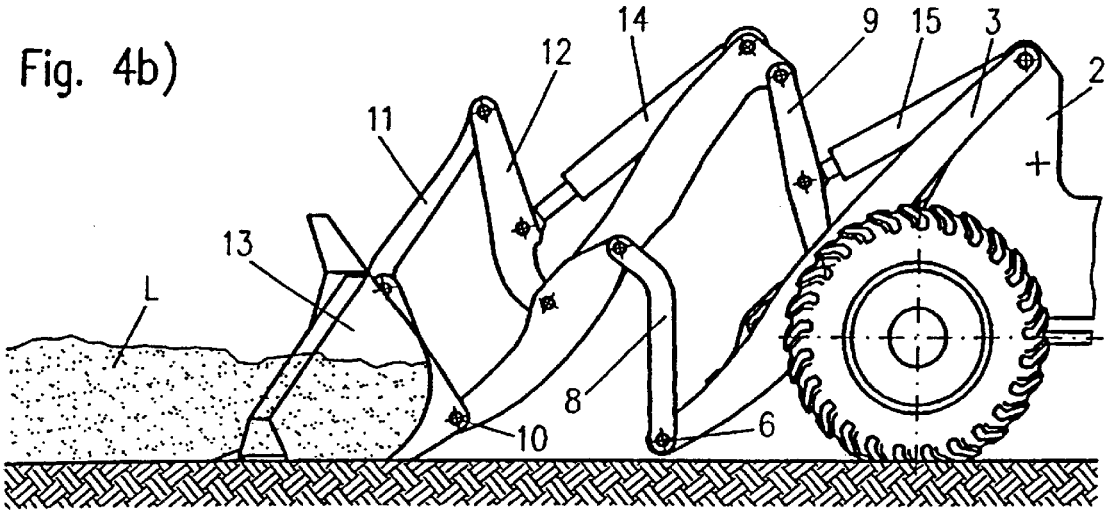
Figure 4C:
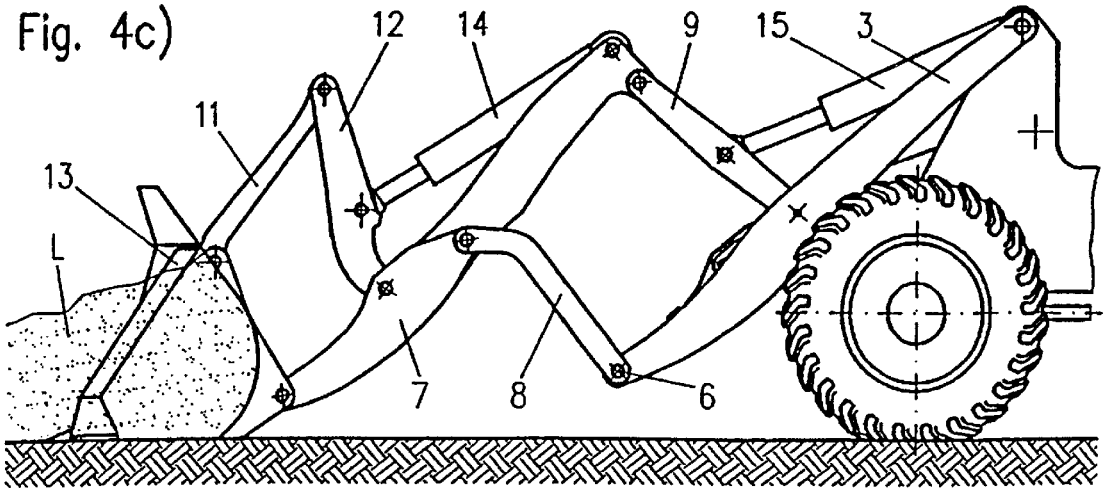

FIGS. 4*a* to 4*c* show the horizontal displacement of the boom of the shovel loader according to the invention from FIG. 1 in a sequence in which the loading shovel is displaced forward along the floor.

Figure 5:
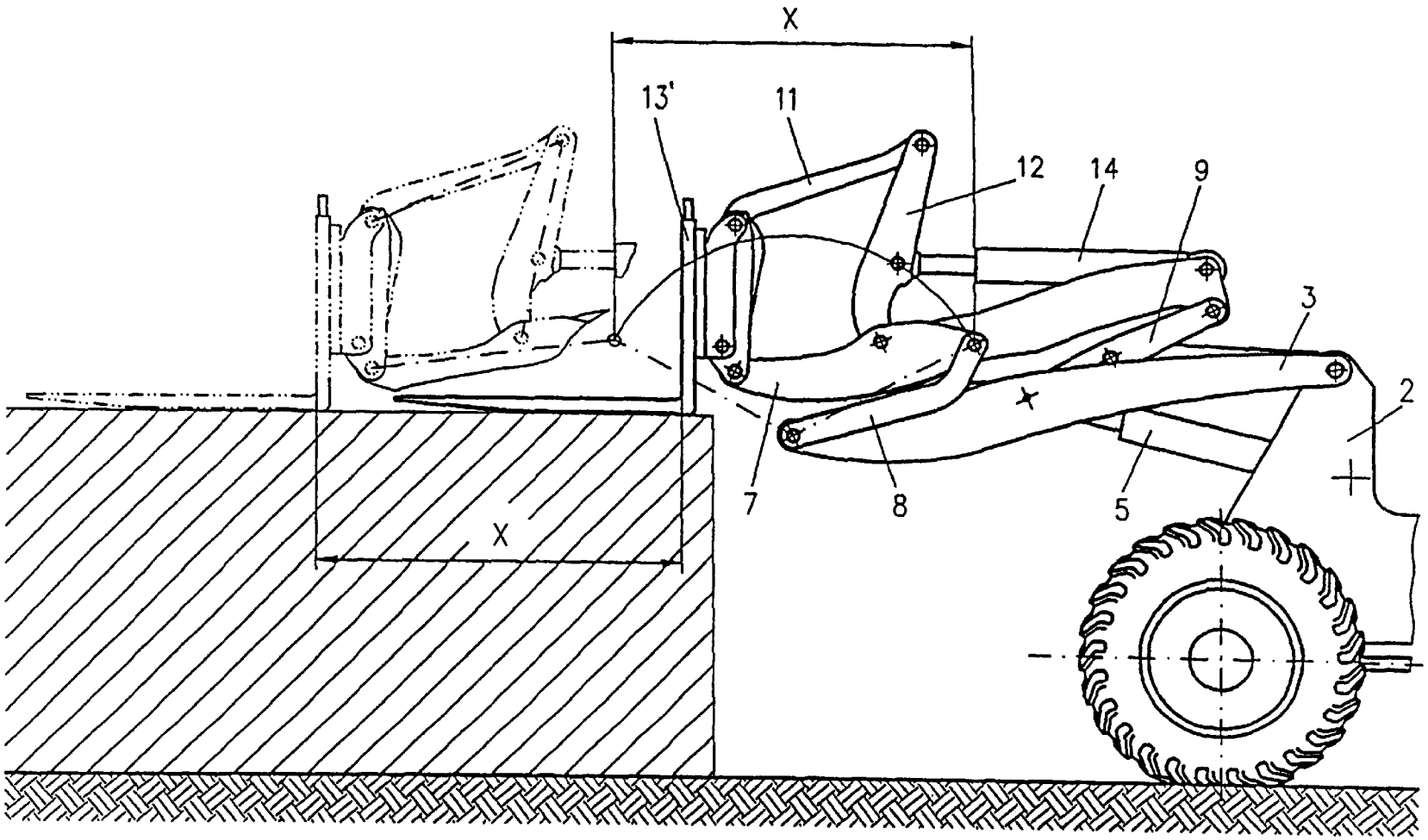

FIG. 5 shows the shovel loader according to the invention from FIG. 1 with a stacking fork as the tool replacing the loading shovel in a horizontal displacement of the boom along a raised horizontal plane.

FIG. 1 shows a wheeled shovel loader 1 on tires according to the invention with center pivot steering. Of course, the invention can also be realized with other conventional shovel loaders with axle pivot steering, caterpillar tracks, and similar devices. A boom 3 is rotatably hinged around a boom swivel pin 4 on a front section of the vehicle superstructure 2 (loading frame) forming the shovel loader 1 (cf. also FIG. 3). A first lifting cylinder 5 serving to pivot the boom 3 engages on one end on the loading frame and on the other hand approximately in the middle of the boom 3. The components boom 3, boom swivel pin 4, and lifting cylinder 5 correspond as much as possible with the serial parts of a commercially available shovel loader.

According to the invention, the shovel loader 1 includes an additional arm 7 whose length in the exemplary embodiment illustrated and described is essentially somewhat shorter than the length of the boom 3. The additional arm 7 is hinged by means of a first connecting rod 8 and a second connecting rod 9 on the boom like a parallel linkage or parallelogram in such a way that in its retracted position it lies directly on the boom 3 (cf. also FIG. 2). The connecting rods 8, 9 can each be individual connecting rods or can also, in particular, be symmetrically positioned pairs of connecting rods. The first connecting rod 8 is hereby hinged on an end of the boom 3 further from the boom swivel pin 4 around a rotational axis 6, which is the shovel-tipping axis of the serial boom 3, while the connecting rod 9 engages approximately in the region of the center of the boom 3. In the exemplary embodiment depicted, the hinge pin 18 of the second connecting rod 9 coincides on the boom 3 with the hinge pin of the first lifting cylinder 5, which can naturally be implemented differently in other embodiments.

Each of the other ends of the connecting rods 8, 9 are positioned on the additional arm 7, approximately in the region of the center of the additional arm 7 (connecting rod 8) and on an end 19 pointing toward the shovel loader 1 (connecting rod 9). For displacement of the additional arm 7 out of and into its retracted position on the boom 3, a second lifting cylinder 15 is provided which is hinged on one end approximately in the center of the connecting rod 9 and on the other end on the boom 3 and/or on the boom swivel pin 4. Of course, other linkages of the second lifting cylinder 15, as well as the further actuator necessary for operation of the entire boom and the loading shovel, are also possible. Both the first and the second lifting cylinder can be arrangements of pairs of hydraulic cylinders, insofar as the size and/or the load to be managed by the loader require this.

On the end of the additional arm 7 opposite to the end 19, a loading shovel 13 is pivotably hinged around a shovel hinge pin 10. The operation of the loading shovel 13 is performed by means of a tilting structure 11, 12 which includes a tilting lever 11 [sic] hinged on (approximately the center of) the additional arm 7 and a tilting bar 11 connecting the tilting lever 12 with the loading shovel 13. The operation of the tilting structure 11, 12 is performed by means of a tilting cylinder 14, which engages on one end on a central section of the tilting lever 12 and on the other end on the end 19 of the additional arm 7 pointing toward the shovel loader 1. The loading shovel 13, the tilting structure 11, 12, and the tilting cylinder 14 can correspond to normal serial devices and can differ from the example depicted.

Angle sensors 16 and 17, respectively, are positioned on the boom swivel pin 4 and on the shovel hinge pin 10. The angle sensors 16, 17 serve to determine the relative angle between the boom 3 and the vehicle superstructure 2, and/or the attitude of the loading shovel 13 to the additional arm 7. Electronic control of the hydraulic cylinders 14, 15 is performed with reference to the angle and/or position values determined by the angle sensors 16, 17. The angle sensor 16 is a component of means for control of the displacement of the additional arm 7, as is described in the following. Of course, other suitable sensors could be used in place of the angle sensors described, for example position sensors, which are preferably positioned on the boom 3 or on the first lifting cylinder 5.

During operation of the shovel loader 1 according to the invention, after the loading shovel 13 is filled and tilted inward, the loading shovel 13 is lifted by pivoting the boom 3 around the boom swivel pin 4 by means of the first lifting cylinder 5. During this upwards pivoting movement, the rotational axis 6 (shovel pivot point of the serial device) describes a circular path K1 (up to the highest position A) and the shovel hinge pin 10 describes a circular path K2, which leads through a horizontal position D. In the position D, the shovel hinge pin 10 lies at the same height as the boom swivel pin 4 and the maximum extension appropriate for the minimum tipping load is achieved.

Figure 2:
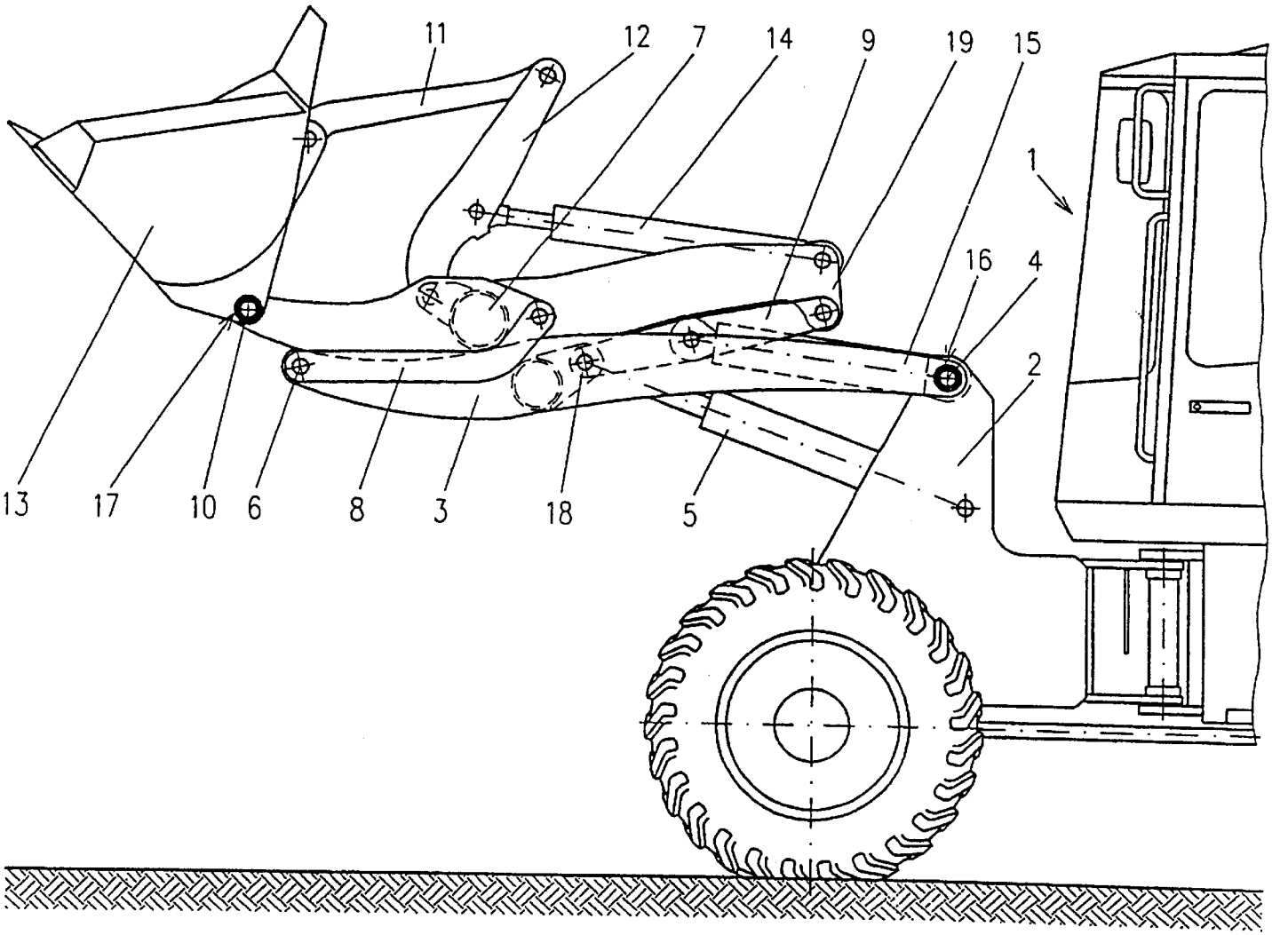
FIG. 2 shows an enlarged view of the front section of the shovel loader of FIG. 1 with the boom in an approximately horizontal position.
Figure 3:
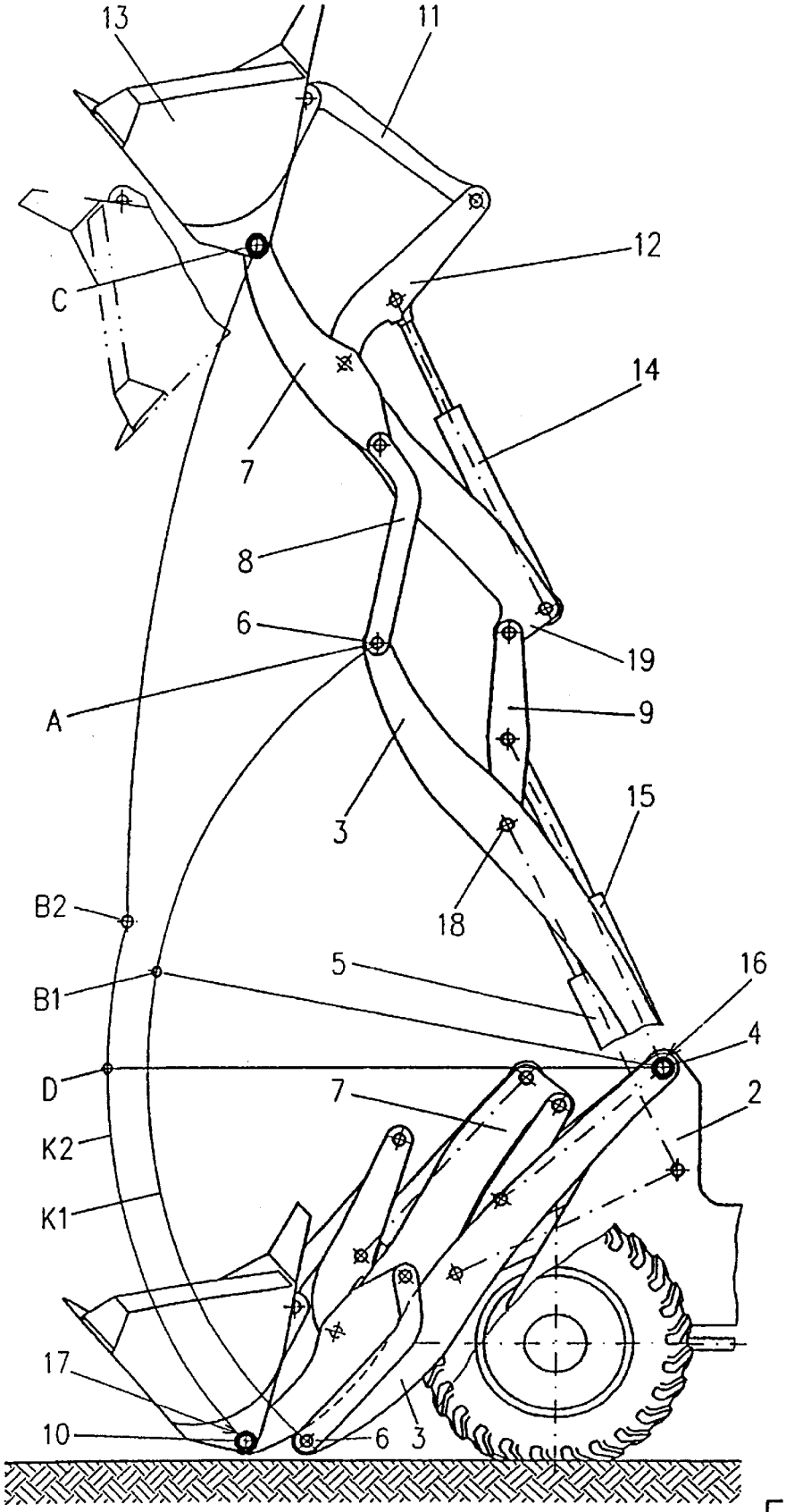
FIG. 3 shows an enlarged section from FIG. 1 of the front section of the shovel loader according to the invention with a completely retracted boom and a completely extended boom.

During the upward pivoting movement of the boom 3, the additional arm 7 first remains inactivated in its retracted position on the boom 3, while controlled operation of the loading shovel 13 is performed by means of the tipping cylinder 14 through an angle sensor 17 and control means connected with it, which are not depicted in more detail, in such a way that the opening of the loading shovel 13 always points upward (parallel maintenance function—cf. FIG. 2, in which the entire boom is illustrated in the position indicated in FIG. 3 with D).

After passing through the position D, i.e., after the maximum extension has been reached, a displacement of the additional arm 7 begins, after a predetermined angular position of the boom 3 has been reached, by means of the second lifting cylinder 15, which is controlled via the electronic control means connected with the angle sensor 16. In the exemplary embodiment depicted in the figure, the displacement of the additional arm 7 occurs after a position B1 of the rotational axis 6 of the boom 3, which lies approximately 10° above the horizontal, has been reached. Of course, displacement of the additional arm 7 can also began in other positions, which, however, preferably all lie above the maximum extension, in order to prevent exceeding the maximum extension and/or to ensure tipping safety, even during loading work on slightly sloping terrain.

The position B1 of the rotational axis 6 corresponds to a position B2 of the shovel hinge pin 10, which represents the end point of the circular path K2 of the shovel hinge pin 10 up to this point, because now the shovel hinge pin 10 on the end of the additional arm 7 is moved upward more strongly than on the circular path K2 by operation of the additional arm 7 and the extension associated with it. The parallel maintenance function by hydraulic electronic equalization of the angular position between the loading shovel and the additional arm 7 is thereby overlaid with a folding out movement of the additional arm 7, so that after the position A has been reached through the rotational axis 6 of the boom 3, the shovel hinge pin 10 of the additional arm 7 has reached the highest position C.

As already mentioned in the preceding, conversely, during the downward movement of the boom 3, the retraction procedure of the additional arm 7 is controlled in such a way that the additional arm 7 is again completely retracted by, at latest, when the position B1 has been reached. This measure according to the invention ensures that the maximum extension reached in position D is never exceeded.

The horizontal displacement of the loading shovel below the horizontal position of the boom 3 is depicted in the FIGS. 4*a* to 4*c*. FIG. 4*a* shows the shovel loader according to the invention from FIG. 1 in its initial position with boom lowered and loading shovel 13 tipped outward. To take goods L into the loading shovel 13, the shovel loader is typically moved in the direction of the goods L until a sufficient amount of goods is in the loading shovel 13. If this is not possible due to, for example, unsuitable condition of the ground, then, according to the invention, the boom can now be moved forward by operation of the additional arm 7, as is depicted in FIGS. 4*b* and 4*c*. For this purpose, the second lifting cylinder 15 is operated and the connecting rods 8, 9 are displaced. Simultaneously, the boom 3 is shifted into a so-called floating position, in which it is operated by means of the first lifting cylinder 5 in such a way that equalization of the circular path of the loading shovel 13 due to the displacement of the additional arm 7 occurs, so that the loading shovel 13 moves along an essentially horizontal plane, determined by the ground.

When the loading shovel 13 has been moved far enough forward in this way that it is sufficiently filled with the goods L (FIG. 4*c*), the filled loading shovel is tipped inward. Before the boom 3 can be lifted by operation of the first lifting cylinder 5, the additional arm 7 must be completely retracted again. This position corresponds to the position illustrated in FIG. 4*a*, with the difference that the loading shovel 13 is tipped upward. Only then can the lifting of the boom 3 proceed, as described in the preceding in connection with FIGS. 1 to 3. An electric angle or path detector is preferably provided on the connecting rod 9 or on the second lifting cylinder 15 which registers the position of the additional arm 7 and only releases the lifting movement for the boom 3 when the additional arm 7 is completely retracted. Sufficient tipping safety is thereby insured.

In FIG. 5, a corresponding use of the horizontal displacement along a horizontal plane at a distance from the ground is illustrated using stacking as an example. For this purpose, the loading shovel 13 in the shovel loader according to the invention of FIGS. 1 to 4 is replaced as the tool by a stacking fork 13'. The horizontal movement of the additional arm 7 according to the invention described in the preceding with reference to FIGS. 4*a* to 4*c* can also be utilized in this raised position, as is illustrated by the dash-dot illustration, without the shovel loader having to be moved forward or backward.

The particular advantage of the invention is based in that the shovel loader according to the invention can be obtained from a serial shovel loader with relatively simple means by replacement of the boom, without significantly changing the stability with an overlong boom and with all of the tools of the serial device still able to be used. A small serial shovel loader can thereby be used for high loading work according to the invention, with the added weight of the additional arm compensated for by an additional counterweight (reference number 20 in FIG. 1).

The circular paths K1 and K2 can coincide in an advantageous case. If, however, they are separated from one another, as in the exemplary embodiment depicted, this displacement of the centers of gravity must also be compensated for by the additional counterweight 20.

Of course, the invention is not restricted to the exemplary embodiment illustrated in the figures, but also includes other alterations in construction. In particular, the pair of connecting rods 8 and 9 do not have to be essentially the same length, as in the embodiment depicted, but can also be implemented with different lengths. In addition, the number of connecting rods and their hinge points can be selected freely without leaving the framework of the invention. Furthermore, the boom 3 and/or the additional arm 7 can be equipped as desired, for example as a so-called mono boom, with hollow body box design, or as a frame formed from two side parts, as shown in the example.

What is claimed is:

1. A wheeled shovel loader comprising:

a) a boom, said boom adapted to pivot;

b) a loading shovel;

c) a tipping structure, said tipping structure operatively associated with said loading shovel;

d) at least one additional arm, said at least one additional arm extending between and connecting each of said boom and said loading shovel, e) at least one first connecting rod and at least one second connecting rod, said at least one first connecting rod and said at least one second connecting rod cooperate to hingedly connect said at least one additional arm to said boom and extending therebetween so that said at least one additional arm is adapted to be selectively displaced relative to said boom between a retracted and extended position in the manner of a parallel linkage or parallelogram upon movement of said at least one first connecting rod and at least one second connecting rod;

f) a lifting cylinder for retracting and extending said at least one additional arm, said lifting cylinder connected at one end thereof to at least one of said boom and a vehicle superstructure of said shovel loader and connected at an opposite end thereof to at least one of said at least one first connecting rod and said at least one second connecting rod; and g) a displacement control, said displacement control operatively associated with said at least one additional arm for selectively controlling the position of the same in response to the angular position of said boom relative to said shovel loader whereby said loading shovel is maintained in a desired position relative to said at least one additional arm.

2. A shovel loader as in claim 1 and wherein said at least one additional arm may be displaced from the retracted position only after said boom has passed through a horizontal position relative to said wheeled shovel loader.

3. A shovel loader as in claim 1 and wherein said displacement control includes at least one angle sensor.

4. A shovel loader as in claim 1 and wherein said displacement control includes at least one position sensor.

5. A shovel loader as in claim 1 and wherein said at least one additional arm is adapted to be displaced within an essentially horizontal plane relative to said shovel loader when said boom is caused to be shifted into a floating position so that movement of said loading shovel following displacement of said at least one additional arm is caused to be compensated for.

6. A shovel loader as in claim 5 and further comprising:

a) an electric angle or position sensor, said electric angle or position sensor is operatively associated with said boom to permit lifting movement thereof when said at least one additional arm is in the retracted position.

7. A shovel loader as in claim 1 and wherein said at least one first connecting rod and said at least one second connecting rod are substantially equal in length.

8. A shovel loader as in claim 1 and wherein at least one of said boom and said at least one additional arm have at least one of a hollow box configuration or a lifting frame configuration comprising two side walls and a transverse connection.

9. A shovel loader as in claim 1 and further comprising:

a) a boom lifting cylinder, said boom lifting cylinder connected at one end thereof to a vehicle superstructure of said wheeled shovel loader and at an opposite end thereof to said boom to provide pivoting movement of the same.

10. A shovel loader as in claim 1 and wherein at least one of said at least one first connecting rod and said at least one second connecting rod has a bent portion.

11. A shovel loader as in claim 1 and further including a boom swivel pin, said boom swivel pin for pivotally connecting at least one of said boom and said one end of said lifting cylinder to a vehicle superstructure of said shovel loader.

12. A wheeled shovel loader comprising:

a) a boom, said boom adapted to pivot;

b) a loading shovel;

c) a tipping structure, said tipping structure operatively associated with said loading shovel;

d) at least one additional arm, said at least one additional arm extending between and connecting each of said boom and said loading shovel, e) at least one first connecting rod and at least one second connecting rod, said at least one first connecting rod and said at least one second connecting rod cooperate to hingedly connect said at least one additional arm to said boom and extending therebetween so that said at least one additional arm is adapted to be selectively displaced relative to said boom and independently thereof between a retracted and extended position in the manner of a parallel linkage or parallelogram upon movement of said at least one first connecting rod and at least one second connecting rod; and f) a displacement control, said displacement control operatively associated with said at least one additional arm for selectively controlling the position of the same in response to the angular position of said boom relative to said shovel loader whereby said loading shovel is maintained in a desired position relative to said at least one additional arm.

13. A shovel loader as in claim 12 and wherein said at least one additional arm may be displaced from the retracted position only after said boom has passed through a horizontal position relative to said wheeled shovel loader.

14. A shovel loader as in claim 12 and wherein said displacement control includes at least one angle sensor.

15. A shovel loader as in claim 12 and wherein said displacement control includes at least one position sensor.

16. A shovel loader as in claim 12 and wherein said at least one additional arm is adapted to be displaced within an essentially horizontal plane relative to said shovel loader when said boom is caused to be shifted into a floating position so that movement of said loading shovel following displacement of said at least one additional arm is caused to be compensated for.

17. A shovel loader as in claim 16 and further comprising:

a) an electric angle or position sensor, said electric angle or position sensor is operatively associated with said boom to permit lifting movement thereof when said at least one additional arm is in the retracted position.

18. A shovel loader as in claim 12 and wherein said at least one first connecting rod and said at least one second connecting rod are substantially equal in length.

19. A shovel loader as in claim 12 and wherein at least one of said boom and said at least one additional arm have at least one of a hollow box configuration or a lifting frame configuration comprising two side walls and a transverse connection.

20. A shovel loader as in claim 12 and further comprising:

a) a boom lifting cylinder, said boom lifting cylinder connected at one end thereof to a vehicle superstructure of said wheeled shovel loader and at an opposite end thereof to said boom to provide pivoting movement of the same.

21. A shovel loader as in claim 12 wherein at least one of said at least one first connecting rod and said at least one second connecting rod has a bent portion.

22. A shovel loader as in claim 12 and further including a lifting cylinder for retracting and extending said at least one additional arm, said lifting cylinder connected at one end thereof to at least one of said boom and a vehicle superstructure of said shovel loader and connected at an opposite end thereof to at least one of said at least one first connecting rod and said at least one second connecting rod.

23. A shovel loader as in claim 22 and further including a boom swivel pin, said boom swivel pin for pivotally connecting at least one of said boom and said one end of said lifting cylinder to a vehicle superstructure of said shovel loader.

* * * * *